United States Patent [19]

Green et al.

[11] 4,305,217

[45] Dec. 15, 1981

[54] COUPON SORTER

[76] Inventors: Lorna A. Green; Joseph C. Green, both of 6813 Riverdale Rd., Apt. K-5, Riverdale, Md. 20840

[21] Appl. No.: 117,989

[22] Filed: Feb. 4, 1980

[51] Int. Cl.[3] ..... B42F 17/06

[52] U.S. Cl. ..... 40/374; 40/383; 220/22.5; 312/183; 312/330 R

[58] Field of Search ..... 40/371, 373, 374, 375, 40/380, 383, 384, 495, 503, 115; 220/22.3, 22.5; 312/183, 184, 193, 187, 330

[56] References Cited

U.S. PATENT DOCUMENTS

| | | | |
|---|---|---|---|
| 1,533,002 | 4/1925 | Haberfeld | 220/20 |
| 1,738,419 | 12/1929 | Burger | 220/22.3 |
| 2,098,394 | 11/1937 | Lane | 40/380 |
| 2,246,633 | 6/1941 | Lawlor | 40/495 |
| 2,407,055 | 9/1946 | Bradner | 220/22.5 |
| 3,279,471 | 10/1966 | Ruina | 40/383 X |
| 4,005,797 | 2/1977 | Ingram | 312/183 X |

*Primary Examiner*—Gene Mancene
*Assistant Examiner*—G. Lee Skillington
*Attorney, Agent, or Firm*—Stevens, Davis, Miller & Mosher

[57] ABSTRACT

A partitioned structure comprising an open topped container and a plurality of dividers having sides positioned within the container. The container has horizontal interior side channels on either side thereof so that each divider having at least one tab disposed on each side thereof slides within one of the horizontal channels and permits movement of the divider relative to the container. Each divider has a projection extending above its top on which information is placed.

3 Claims, 6 Drawing Figures

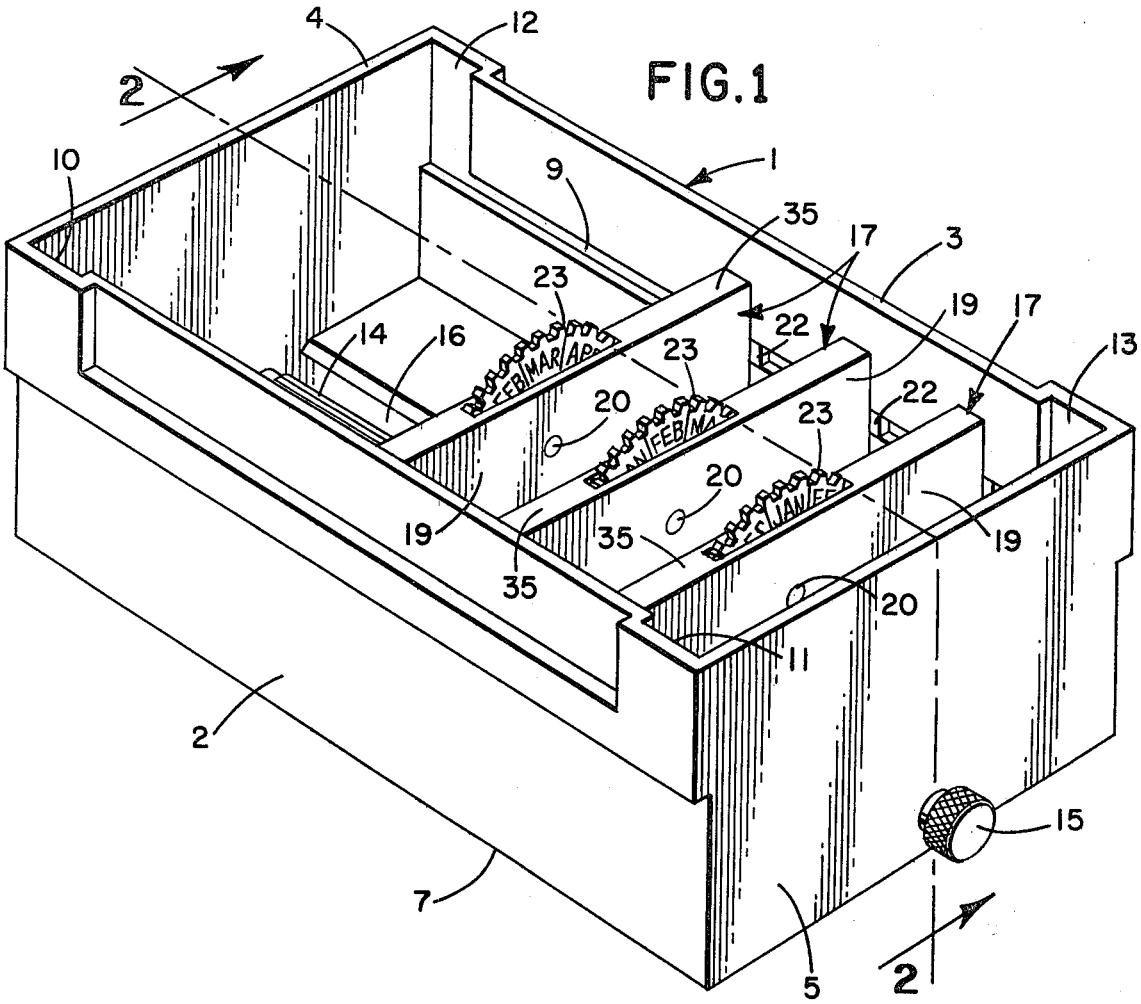
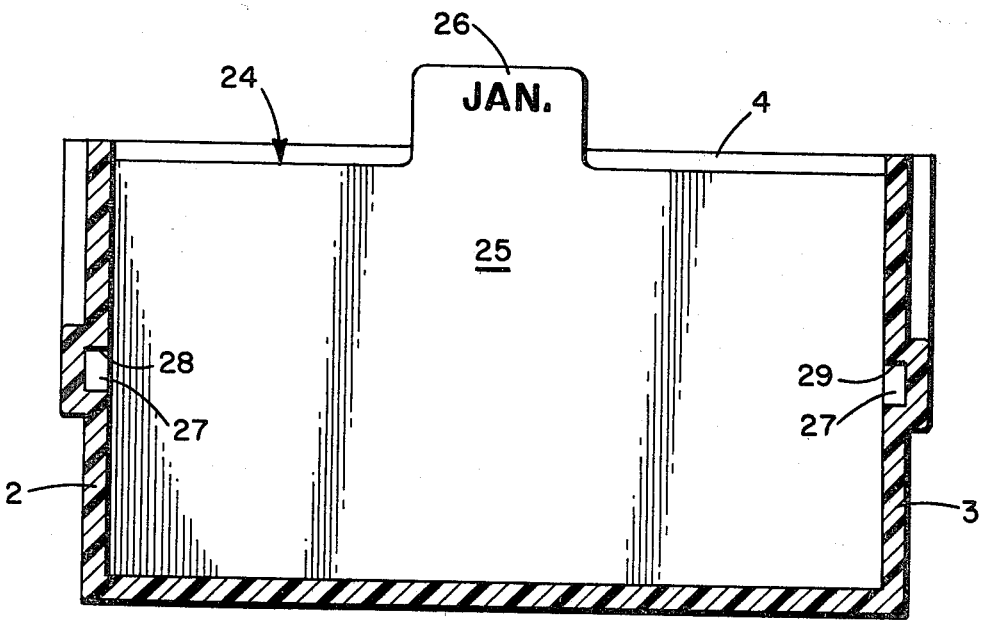
FIG. 6

COUPON SORTER

The invention relates to a partitioned structure for maintaining items separated by date or subject matter. More particularly, the invention relates to a partitioned structure for maintaining food coupons divided either by date of use or by type of item.

As a result of the quantity of coupons being issued by the manufacturer of consumer products on a regular basis and the savings that can be enjoyed through utilization of such coupons, the public in increasing numbers is clipping and saving coupons for subsequent use.

One of the problems with clipping coupons is that of making the coupon readily available for use at the time of need. Without a breakdown of the coupons either as to the date of expiration or as to subject matter or both, the coupon holder is required to sort continuously for the coupon desired.

It is known to place dividers in spaces to permit the categorization of items. However, one of the problems of utilizing such dividers is that the dividers do not maintain an upright position unless the spaces created by the dividers are substantially filled with items. Another problem is that with currently known dividers the order of sort cannot be changed readily.

It is therefore an object of the invention to provide a means whereby the coupons may be categorized by date of expiration or subject matter or both.

Another object of the invention is to provide a means in the container for maintaining the dividers in an upright position even when the container is empty of coupons.

A further object of the invention is to provide a container with dividers wherein the dividers easily may be inserted or withdrawn to change the order of sort.

A still further object of the invention is to provide a container with dividers upon which changeable information is made available without removal of the divider from the container.

According to the invention the partitioned structure includes an open-topped container and a plurality of dividers positioned within the container. The container has horizontal interior side channels and two vertical interior channels intersecting the horizontal channels on each side. Each divider is composed of at least one panel which carries a tab on each side to slide within the horizontal channels of the container and maintain the panel in a vertical position. Extending from the top of the panel is a projection on which information is placed to aid in the sort of the coupons. The vertical channels permit the insertion and removal of the dividers from the container. In order to change the information extending above the panel the information is placed on a disk rotatably mounted on the panel with a portion thereof extending above the panel. The rotation of the disk is accomplished by having the disk in the form of a gear meshing with a splined rod rotatably positioned in the lower portion of the container and rotatable from outside of the container.

Other details and features of the invention will stand out from the description given below by way of non-limitative example and with reference to the accompanying drawings, in which:

FIG. 1 is a perspective view of one embodiment of the present invention;

FIG. 6 is a cross-sectional view of FIG. 5 taken along lines 6—6.

Figure 2:
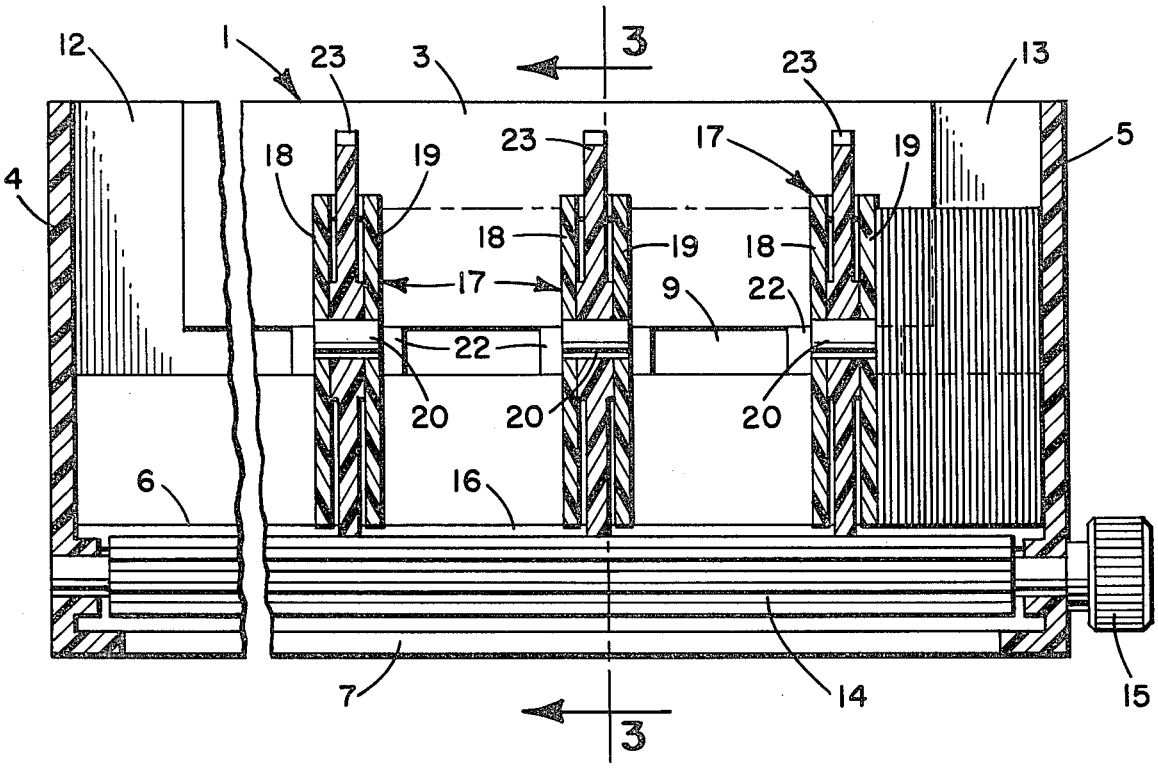
FIG. 2 is a cross-sectional view of the embodiment of FIG. 1 taken along lines 2—2; p
Figure 3:
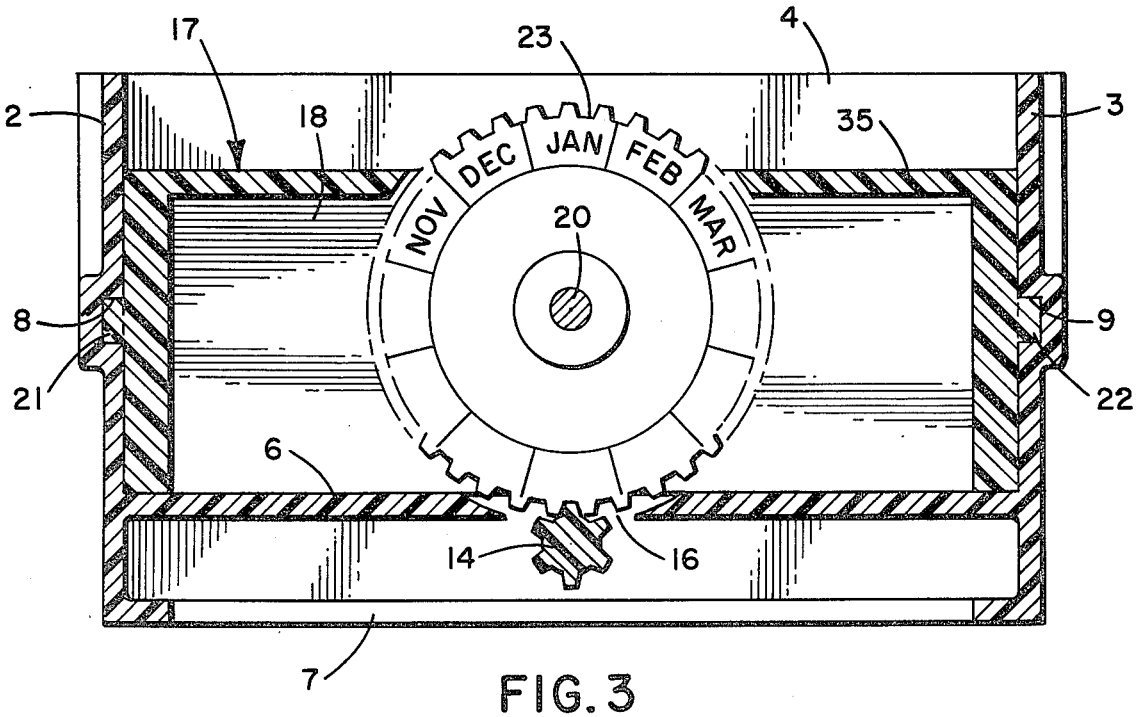
FIG. 3 is a cross-sectional view of FIG. 2 taken along lines 3—3.

Referring to FIGS. 1–3, there is shown a container 1 defined by sides 2 and 3, ends 4 and 5, bottom 6 (FIG. 3) and base 7. Horizontally extending along sides 2 and 3 are respectively internal channels 8 (FIG. 3) and 9. At each end of side 2 are vertical channels 10 and 11 and correspondingly at each end of side 3 are vertical channels 12 and 13.

Rotatably fixed in the center of each end of the base 7 is a rod 14 splined throughout most of its length. On one end of rod 14 extending beyond the base 7 there is attached a knob 15. The bottom 6 has a longitudinal opening 16 therein extending from one end 4 to the other end 5. Splined rod 14 extends along and in said opening 16 (FIG. 3). Fitting within container 1 are dividers 17. Each divider 17 is comprised of vertical panels 18 and 19 in which is anchored a pin 20. On each side of panels 18 and 19 are respectively, tabs 21 and 22. The tabs slide in the channels 8 and 9 to maintain the dividers in an upright position regardless of the number of coupons collected. The horizontal internal channels are for the purpose of regulating the size of the space between dividers by movement of the dividers along the channels. The vertical channels are for the purpose of removing dividers from the container 1 or inserting them therein. Between panels 18 and 19 on pin 20 is rotatably mounted a gear 23. Gear 23 has a portion thereof which extends above the top of the panels and a portion which extends below the bottom of the panels. The portion which extends above the panels has information thereon which can be readily seen and is utilized in determining the sort of coupons. The portion which extends below the panels fits into the opening 16 and permits the teeth of gear 23 to mesh with splined rod 14 so that upon turning the knob 15 the gear is rotated thereby changing the information on the portion of the gear extending above the panels 18 and 19. Thus if the sort of the coupons is by date and only three dividers are used as shown in FIGS. 1 and 2, the month showing on the most forward divider indicates the first bin and the current month in which coupons are to be utilized. The second divider sets out a second bin and indicates the next month in which the coupons must be used. The last divider sets out a third bin and the following month for utilization of the coupons. Once the first bin has been exhausted of coupons the knob is rotated to advance the months of the first, second and third dividers and the coupons are advanced from the second bin to the first and from the third to the second. The unsorted coupons which may be deposited in the bin behind the third are then sorted for placement in the third bin. If twelve dividers are present only the initial sort as to month is necessary. The panels may have a top 35 if desired.

Figure 4:
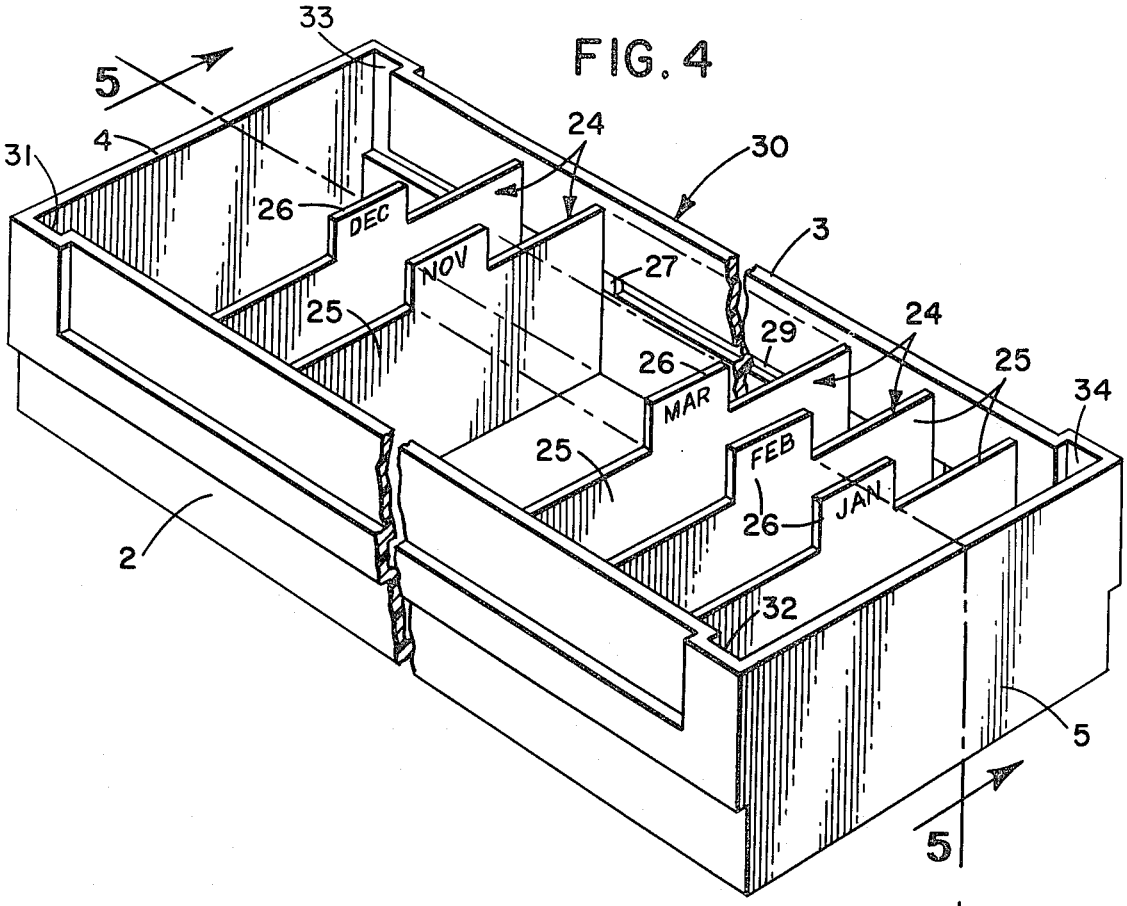
FIG. 4 is a perspective view of a second embodiment of the present invention.
Figure 5:
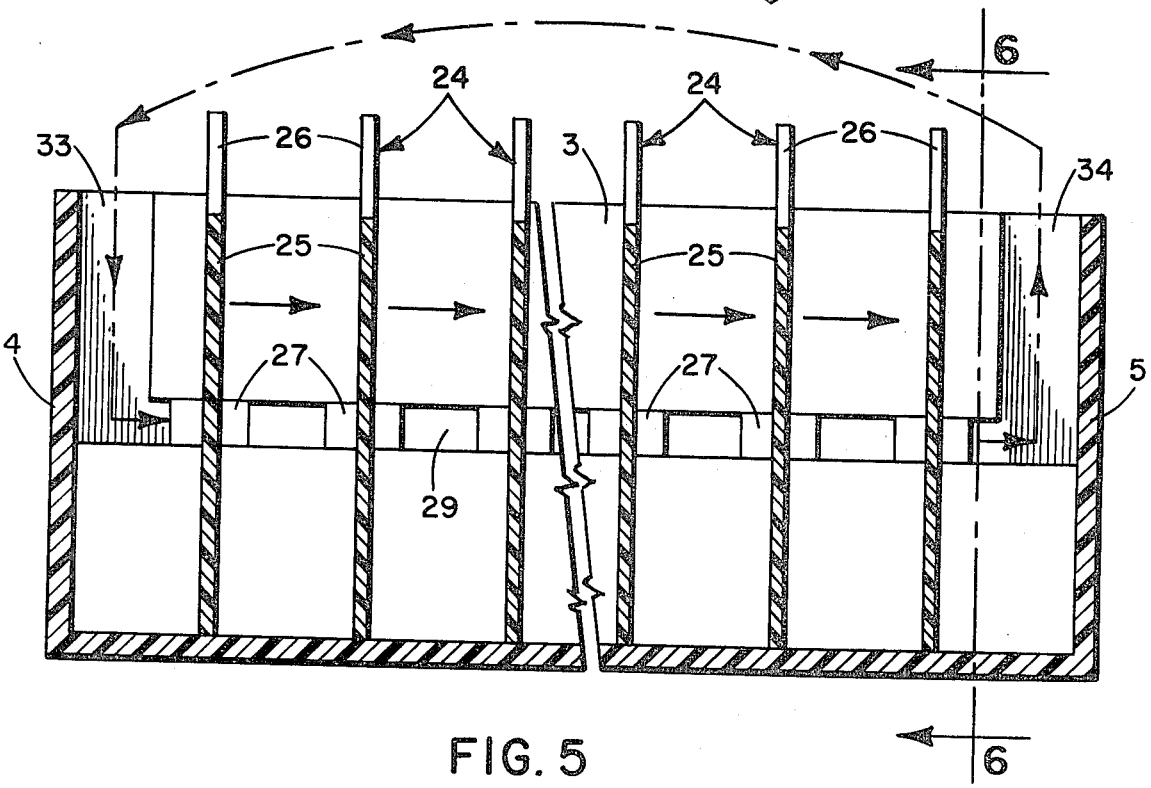
FIG. 5 is a cross-sectional view of the embodiment of FIG. 4 taken along lines 5—5.

In FIGS. 4–6 a further embodiment is shown. Each divider 24 is comprised of a single panel 25 having a projection 26 extending thereabove and a tab 27 extending from each side to slide in horizontal channels 28 and 29. Each divider may be removed from or inserted into the container 30 by moving tabs 27 in vertical channels 31 and 32 or 33 and 34. The embodiment of FIGS. 4–6 is utilized by removing the front divider after its bin has been exhausted and moving the divider to the rear while moving each of the remaining dividers forward.

The container and dividers may be made from metal such as steel or plastic such as polyethylene or polyvinyl resin.

What is claimed is:

1. A partitioned structure comprising an open topped container and a plurality of dividers having sides positioned within said container, said container comprising horizontal interior side channels on either side thereof, each said divider having at least one tab disposed on each side thereof to slide within one of said horizontal channels and permit movement of said divider relative to said container, each said divider being comprised of two vertical panels and a gear, said gear being rotatably positioned between said vertical panels and having a portion thereof extending above said panels and a splined rod and knob on one end thereof rotatably positioned on said container in mesh with said gear so that turning of said rod changes the portion of gear extending above said panels.

2. The structure of claim 1 wherein said container includes interior vertical channels intersecting each horizontal channel to permit removal and insertion of dividers in said container.

3. The structure of claim 1 wherein each panel contains a tab on each vertical side thereof.

* * * * *